166-274

2/8/83 XR 4,372,383 SR

United States Patent [19]

Ames

[11] 4,372,383

[45] Feb. 8, 1983

[54] IN SITU SEPARATION OF BITUMEN FROM BITUMEN-BEARING DEPOSITS

[75] Inventor: Robert K. Ames, Seattle, Wash.

[73] Assignee: Reflux Limited, Seattle, Wash.

[21] Appl. No.: 270,261

[22] Filed: Jun. 4, 1981

Related U.S. Application Data

[63] Continuation-in-part of Ser. No. 236,047, Feb. 19, 1981.

[51] Int. Cl.[3] ..... E21B 43/22; E21B 43/40

[52] U.S. Cl. ..... 166/266; 166/267; 166/274; 166/304

[58] Field of Search ..... 166/266, 267, 271, 272, 166/273, 274, 303, 304, 305 R, 312

[56] References Cited

U.S. PATENT DOCUMENTS

| | | | |
|---|---|---|---|
| 2,288,857 | 7/1942 | Subkow | 166/305 R X |
| 2,859,818 | 11/1958 | Hall et al. | 166/274 X |
| 2,882,973 | 4/1959 | Doscher et al. | 166/266 |
| 3,221,813 | 12/1965 | Closemann et al. | 166/272 X |
| 3,279,538 | 10/1966 | Doscher | 166/272 X |
| 3,581,823 | 6/1971 | Feuerbacher | 166/267 |
| 3,648,771 | 3/1972 | Kelly | 166/272 |
| 4,156,463 | 5/1979 | Hall | 166/272 |
| 4,191,252 | 3/1980 | Buckley et al. | 166/303 X |
| 4,212,353 | 7/1980 | Hall | 166/267 X |

*Primary Examiner*—James A. Leppink
*Assistant Examiner*—George A. Suchfield
*Attorney, Agent, or Firm*—Christensen, O'Connor, Johnson & Kindness

[57] ABSTRACT

A method for in situ separation of bitumen from bitumen-bearing subterranean deposits includes the step of injecting a solvent composition into the deposit. The solvent composition must have an inverse critical solution temperature in a two-phase system with water and be selected from a particular group of amines that includes triethylamine and diisopropylamine. When the solvent composition contacts the bitumen in the deposit, the bitumen is dissolved by the solvent. Thereafter, the bitumen/solvent mixture is removed and separated into a bitumen component and a solvent component. The bitumen is thereafter processed to yield a usable petroleum product.

10 Claims, No Drawings

IN SITU SEPARATION OF BITUMEN FROM BITUMEN-BEARING DEPOSITS

BACKGROUND OF THE INVENTION

This application is a continuation-in-part of prior copending application Ser. No. 236,047, filed Feb. 19, 1981, which is expressly incorporated herein by reference, and the benefit of the filing date of which is hereby claimed under 35 USC 120.

The present invention relates to methods for separating bitumen from bitumen-bearing materials, and more particularly to the separation of bitumen in situ from bitumen-bearing deposits.

Bitumen-bearing sand deposits commonly referred to as "tar sands" or "oil sands" occur in North and South America, principally in the United States, Canada, and Venezuela. These bitumen-bearing deposits have a bitumen content ranging from seven to twelve percent by weight and in high-grade sands, higher than twelve percent by weight. The remainder of the bitumen-bearing sand constitutes water and siliceous and other organic materials. The bitumen in many sand deposits comprises alkane, cycloalkanes, light aromatics, heavy resins (for example, $C_{16}$ hydrocarbons), and asphaltenes. Bitumen, also commonly referred to as petroleum, is also trapped in other subterranean formations. Some of these formations are of the type that can be tapped by conventional drilling methods. However, much of the bitumen in these formations is too viscous to be economically pumped from the geologic strata in which it is trapped. The bitumen therefore must be separated by other methods from the formations or deposits.

Many methods have been suggested to remove bitumen from bitumen-bearing sands and other deposits. Among these are the so-called "thermal recovery" and "solvent recovery" processes and combinations of the two. The solvent and thermal recovery rocesses have been suggested both for removing bitumen from tar sands and for enhancing the recovery from wells from which bitumen recovery has been exhausted by conventional methods. The primary drawback of the thermal and solvent recovery processes is the relatively high expense and less than desirable efficiency. The prior art thermal systems require the generation of and addition of heat to the bitumen-bearing deposits, for example, by the injection of steam or hot water. Thermal generation requires the expenditure of substantial amounts of energy and thus reduces the overall efficiency of thermally based recovery processes. Similarly, known solvent recovery methods either require the addition of heat to the solvent or require expensive pretreatment and posttreatment steps to insure economic solvent and bitumen recovery. Again, the high cost of the addition of heat or the additional treatment steps renders prior art solvent recovery processes either uneconomical or environmentally undesirable. Furthermore, the solvents that have been suggested for use in the solvent recovery systems are either incompatible with water that naturally occurs in the bitumen-bearing substrates, forming undesirable emulsions, or are not universal solvents for the bitumen and other hydrocarbon mateerials occurring in the deposits. For example, the asphaltenes in the bitumen will precipitate out of most conventional solvents that have been suggested for use with solvent recovery processes and, thus, are not recoverable from the deposit.

It is therefore a broad object of the present invention to provide an in situ solvent recovery system for separating bitumen from bitumen-bearing deposits. It is a further object of the present invention to provide a solvent recovery system that does not require the addition of external heat. A further object is to provide a solvent for use in a solvent recovery system that is both compatible with water occurring in the bitumen-bearing substrate, as well as being capable of functioning as a universal solvent for all of the bitumen and bitumen-related materials. It is further an object of the present invention to provide a solvent for such an in situ solvent recovery system that virtually can be completely recovered from the subterranean deposit. It is an additional object of the present invention to provide an economically and environmentally desirable in situ solvent recovery system.

SUMMARY OF THE INVENTION

The foregoing objects and other objects that will become apparent to one of ordinary skill after reading the following specification are provided by the present method for in situ removal of bitumen from subterranean bitumen-bearing deposits. The method is effected by first injecting into the bitumen-bearing deposit a solvent composition having an inverse critical solution (ICS) temperature in a two-phase system with water. The composition is injected into the deposit in an amount sufficient to dissolve substantially all of the bitumen in the deposit. The composition and the dissolved bitumen thereby form a mixture. The mixture is then removed from the deposit and thermally separated into a bitumen component and a solvent composition component. The solvent is selected from a member of or mixtures of members of the groups of amines having the formula:

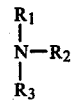

wherein:

$R_1$ is a hydrogen or an alkyl radical, $R_2$ and $R_3$ are alkyl radicals having from 1 to 6 carbon atoms or alkenyl radicals having from 2 to 6 carbon atoms, the total number of carbon atoms in the amine molecule being in the range of from 3 to 7, inclusive.

DETAILED DESCRIPTION OF THE INVENTION

In accordance with a broad aspect of the present invention, a solvent composition having an inverse critical solution (ICS) point, more completely defined below, is injected into a subterranean deposit bearing or comprising bitumen (which term encompasses what is commonly referred to as petroleum). The present invention can be employed with a variety of subterranean bitumen-bearing deposits. The process is especially effective in tar sand deposits. Additionally, the present invention can be employed with other petroleum-bearing strata to remove bitumen that cannot economically or otherwise be extracted by conventional methods. For example, the present invention can be employed as a recovery enhancement system for obtaining additional petroleum from wells that are no longer naturally pressurized or that can no longer be economically pumped. The bitumen-bearing deposit does, however, have to be sufficiently porous so that the solvent composition can pass through and contact the bitumen held captive therein.

The solvent utilized with the present invention is one that exhibits an ICS point in a two-phase system with water. Preferably, the composition exhibits this point at or near atmospheric pressure and prevailing ambient temperature. Below the ICS point water and the solvent composition are completely miscible in all proportions. Above the ICS point the solvent composition and water will separate into two distinct liquid phases. One phase will comprise primarily the solvent composition with a small amount of water in solution therewith; the other phase will comprise primarily water with a small amount of the solvent composition dissolved therein. One class of compounds that exhibits an ICS point is certain of the secondary and tertiary amines. These amines can be used by themselves or in admixture with each other in the process of the present invention. By choosing one amine or a mixture of two or more amines the solvent composition can be tailored to appropriately suit the optimum process parameters for a given set of bitumen separation conditions.

A particularly useful and preferred class of amines that can be used with the present invention is those amines which comprise a member of or mixtures of members of the group having the formula

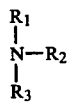

wherein $R_1$ can be hydrogen or alkyl and $R_2$ and $R_3$ can be independently selected from alkyl radicals having from one to six carbon atoms and alkenyl radicals having from two to six carbon atoms, the total number of carbon atoms in the amine molecule being in the range of from 3 to 7, inclusive, the amine exhibiting an ICS temperature in a two-phase system with water. Examples of compounds within this class that can be used in accordance with the present invention are triethylamine and diisopropylamine.

Triethylamine (TEA) presently is preferred as the solvent composition since it exhibits its ICS temperature at about 18.7° C. at a pressure of 760 mm. of Hg. This temperature is very near average atmospheric ambient operating conditions in North America (approximately 23° C.). Thus, only a relatively small amount of energy is required to raise a triethylamine-water system to a temperature above the ICS temperature so that the water and solvent components can easily be separated after the bitumen extraction.

The process of the present invention does not require that heat be added to the solvent composition prior to its injection into the bitumen-bearing deposit. The preferred class of amines, and especially triethylamine and diisopropylamine are effective solvents for bitumen at ordinary ground temperatures on the order of 45° to 65° F. Additionally, most of these amines will function as excellent bitumen solvents at the even higher temperatures encountered in very deep subterranean structures. Once the solvent composition has entered the bitumen-bearing substrate and contacts the bitumen in the substrate, the bitumen is quickly dissolved into the solvent composition. Any water present in the system will also be dissolved into the solvent composition, thus eliminating the formation of troublesome emulsions.

Although not critical, the amount of solvent composition pumped through a given deposit need be no greater than about one part solvent per one part by weight of material through which the solvent is being pumped. A greater solvent-to-material ratio can be employed; however, a greater solvent-to-deposit ratio may result in less efficient removal of the bitumen from the bitumen-bearing deposit.

The bitumen/solvent mixtures can be removed from the subterranean deposit by any of a variety of conventional methods, as shown and suggested for example in U.S. Pat. Nos. 3,811,506; 3,822,748; 3,838,737; 3,838,738; and 3,840,073. Among the simplest of the prior art processes for injecting a solvent into a subterranean deposit and removing that solvent is the procedure whereby the solvent is injected at a first location into a deposit. The solvent is withdrawn at a second location spaced from the first location. The solvent can be driven to the second location by injecting water or other nonpolluting liquid at the first location following the solvent injection. The second liquid tends to drive the solvent toward the second withdrawal location. A variety of other methods, of course, is also available.

A surprisingly large percentage of the solvent can be recovered from the bitumen-bearing substrate by pumping water through the deposit following injection of the solvent composition. It has been found that greater than 99% of the solvent can be recovered in this manner. Solvent recovery can be enhanced even further by pretreatment or posttreatment with dilute aqueous alkaline solution. A suggested solution is a 0.1% by weight aqueous sodium hydroxide solution. Such a solution can be pumped through the deposit in advance of injection of the solvent composition or subsequent to removal of the solvent composition. In either event, it has been found that less than one-tenth of one percent of the solvent remains after such pretreatment or posttreatment procedures. In addition to the alkaline posttreatment procedures, solvent recovery can also be enhanced by the injection of steam or hot water into the deposit. The stream or hot water posttreatment steps can also be combined with each other and/or with the aqueous alkaline posttreatment just described.

Once the mixture of bitumen and solvent composition has been withdrawn from the bitumen-bearing deposit, the bitumen and solvent can be thermally separated from the bitumen by, for example, distillation techniques. The liquid fraction, for example, can be flashed into a distillation column, heated by steam or other heat source. The solvent will boil off the liquid fraction as a water-solvent azeotropic vapor and can be recondensed and forwarded to a decanter explained in more detail below. Any additional water is also removed in the solvent still and is condensed and recycled to the decanter along with the solvent. The bottoms from the distillation substantially comprise the bitumen that has been extracted from the tar sands. The bitumen is forwarded to a second processing location for further refinement into petroleum products that can be utilized in the ordinary channels of consumption. If desired, however, a fractionating column can be substituted for the simple distillation column just described. If a fractionating column is employed, not only can the solvent and water be removed at the upper level of the column, but also the bitumen can be separated into its several primary components, including alkanes and cycloalkanes, light aromatics, resins, and asphaltenes. These components can then be further refined as necessary or desired.

As previously mentioned, ground water occurring in the bitumen-bearing deposit is also taken into solution in the solvent composition. The solvent can be reclaimed from the solvent/water composition by raising the temperature of the solvent above the ICS temperature, causing it to separate into liquid phases, one comprising primarily solvent and the other comprising primarily water. The solvent phase can be decanted and recycled directly to a holding tank awaiting reinjection into the bitumen-bearing substrate. The water phase taken from the decanter can be introduced into a water still in which any residual solvent in the water can be flashed off, recondensed, and reintroduced into the decanter. The water thus produced is substantially pure and can be returned to the environment. Alternatively, the water containing a very minor proportion of solvent can be utilized to flush the bitumen-bearing deposit after injection of the solvent composition.

EXAMPLES

The present invention has thus far been broadly described in relation to a preferred embodiment and alternatives thereto. The following Examples are intended to be instructive to one of ordinary skill in the art so that he will readily be able to make and use the invention. The Examples are also intended to be illustrative of the unique advantages of the invention over prior in situ bitumen separation methods. The Examples are not, however, intended to delimit in any way the protection accorded by Letters Patent hereon.

EXAMPLE I

A laboratory simulation of in situ bitumen extraction conditions was constructed by packing a glass column having a diameter of 0.88 inches was packed with 72 grams of bitumen-bearing tar sand to a depth of six inches. Triethylamine in a ratio of one part by weight (72 grams), solvent to one part by weight sand was fed into the top of the glass column and elutriated through the sand using gravity as the only driving force. The sand was then washed by adding water to the column at the same 1:1 weight ratio and elutriating it through the column. All elutriating was conducted at room temperature (between 65° F. and 70° F.). The original bitumen content of the tar sand was about 7.5% by weight based on the original bitumen-bearing tar sand. The residual bitumen in the sand was analyzed to be 0.074%, thus indicating a bitumen removal efficiency of greater than 99%. The water-wet sand remaining in the column was analyzed for triethylamine and found to contain 0.65 milligrams TEA per gram of sand.

EXAMPLE II

A glass column similar to that utilized in Example I was packed with tar sand containing about 7.5% by weight bitumen based on the total tar sand and bitumen. 72 grams of 0.1% by weight aqueous sodium hydroxide were then elutriated through the column with the assist of a vacuum on the receiving flask. Thereafter, 72 grams of TEA were elutriated through the column with a vacuum assist. The column was then washed with 72 grams of water. The residual bitumen in the sand was analyzed at 0.07%. The residual TEA in the wet sand was analyzed at 0.4 milligrams per gram.

The present invention has been described in relation to a preferred embodiment. One of ordinary skill after reading the foregoing specification may be able to effect various changes, substitutions of equivalents, and other alterations without departing from the broad concepts disclosed herein. It is therefore intended that the scope of protection granted by Letters Patent hereon be limited only by the definition contained in the appended claims and equivalents thereof.

The embodiments of the invention in which an exclusive property or privilege is claimed are defined as follows:

1. A method for in situ removal of bitumen from a subterranean deposit comprising solid matter and bitumen, said bitumen in said deposit comprising greater than about 1% by weight of the total deposit, said method comprising the steps of:

injecting into said deposit a composition having an inverse critical solution (ICS) temperature in a two-phase system with water and being selected from a member of or mixtures of members of the groups of amines having the formula

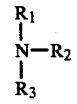

wherein $R_1$ is a hydrogen or an alkyl radical, $R_2$ and $R_3$ are alkyl radicals having from 1 to 6 carbon atoms or alkenyl radicals having from 2 to 6 carbon atoms, the total number of carbon atoms in the amine molecule being in the range of from 3 to 7, inclusive, said composition being present in an amount sufficient to dissolve substantially all of said bitumen in said deposit, said composition and said dissolved bitumen forming a mixture, removing said mixture from said deposit, and thermally separating said mixture into a bitumen component and a composition component.

2. The method of claim 1 wherein said composition is injected into said deposit and contacted with the bitumen in said deposit at ground temperatures without the addition of external heat.

3. The method of claim 1 further comprising injecting an aqueous alkaline material into said deposit to assist in removal of said composition from said deposit.

4. The method of claim 3 wherein said aqueous alkaline material is injected prior to injection of said composition into said deposit.

5. The method of claim 3 wherein said aqueous alkaline material is injected into said deposit after said mixture is removed from said deposit.

6. The method of claim 1 wherein said composition is injected at a first location in said deposit and wherein said mixture is removed from said deposit at a location spaced from said first location.

7. The method of claim 6 wherein said composition is injected at a first location followed by injection of an aqueous liquid at said first location to drive said composition through said deposit.

8. The method of claim 1 wherein said composition comprises a secondary or tertiary aliphatic amine.

9. The method of claim 8 wherein the weight ratio of aliphatic amine to substrate is less than 1.

10. The method of claim 9 wherein the ratio of aliphatic amine to substrate is on the order of 1 to 3 by weight.

* * * * *